United States Patent [19]

Ozawa et al.

[11] 4,019,228

[45] Apr. 26, 1977

[54] CRIMPING APPARATUS

[75] Inventors: Goro Ozawa; Kenzo Kosaka, both of Nagoya; Kasumi Sato, Toyohashi; Akio Ishikawa, Toyohashi; Toshiyuki Nanbu, Toyohashi; Kiyoshi Adachi, Nagoya; Tsutomu Okaya, Nagoya; Takashi Goto, Nagoya; Hiroshi Kitagawa, Nagoya, all of Japan

[73] Assignee: Mitsubishi Rayon Co., Ltd., Japan

[22] Filed: Sept. 10, 1975

[21] Appl. No.: 611,886

Related U.S. Application Data

[60] Division of Ser. No. 355,213, April 27, 1973, abandoned, which is a continuation-in-part of Ser. No. 109,885, Jan. 26, 1971, abandoned.

[30] Foreign Application Priority Data

Mar. 5, 1970 Japan ..... 45-18539

[52] U.S. Cl. ..... 28/1.3; 28/1.4; 28/1.6

[51] Int. Cl.[2] ..... D02G 1/20; D02G 1/16; D02G 1/12

[58] Field of Search ..... 28/1.3, 1.4, 1.6, 72.11, 28/72.12, 72.14

[56] References Cited

UNITED STATES PATENTS

| | | | |
|---|---|---|---|
| 2,914,835 | 12/1959 | Slayter et al. | 28/1.3 X |
| 3,156,028 | 11/1964 | Weiss et al. | 28/1.6 X |
| 3,389,445 | 6/1968 | Schreffler | 28/1.3 |
| 3,438,101 | 4/1969 | Le Noir et al. | 28/1.6 |
| 3,469,293 | 9/1969 | Tsuzimoto et al. | 28/1.6 |
| 3,500,518 | 3/1970 | Stanley et al. | 28/72.14 X |
| 3,501,819 | 3/1970 | Satterwhite | 28/72.11 X |
| 3,816,887 | 6/1974 | Smith et al. | 28/1.4 |

FOREIGN PATENTS OR APPLICATIONS

| | | | |
|---|---|---|---|
| 2,000,929 | 7/1970 | Germany | 28/257 |
| 716,296 | 10/1966 | Italy | 28/256 |

*Primary Examiner*—Louis K. Rimrodt
*Attorney, Agent, or Firm*—Robert E. Burns; Emmanuel J. Lobato; Bruce L. Adams

[57] ABSTRACT

A filamentary strand of a thermoplastic nature is ejected from an ejection nozzle being entrained on a heated medium flow into a stuffing chamber structured on a circulating endless surface moving at a speed slower than the ejection speed and the stuffed filamentary strand is transported, being carried by the endless surface, towards a downstream outlet of the stuffing room in such a way that the yarn mass is gradually compressed during displacement toward the downstream outlet of said stuffing room. During the transportation either a free or a positive cooling is employed. The resultant filamentary strand is provided with random, bulky and round three-dimensional crimps.

9 Claims, 15 Drawing Figures

CRIMPING APPARATUS

Figure 1:
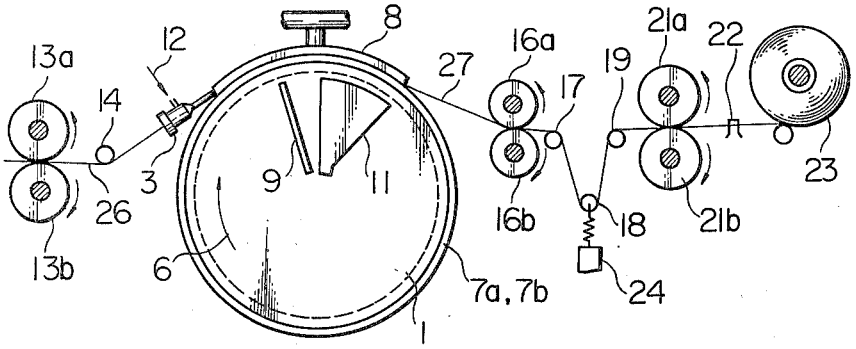

This is a divisional application of our copending U.S. patent application Ser. No. 355,213, filed on Apr. 27, 1973 which was a continuation-in-part of application Ser. No. 109,885 filed Jan. 26, 1971, both now abandoned.

The present invention relates to an improved crimping apparatus and more particularly relates to a crimping apparatus utilizing an ejection of a heated medium in the compulsive supply of a filamentary strand into a stuffing chamber.

As for the crimping system of the type wherein a flowing medium is used, various prior methods have been known.

In one of the apparatus, a nozzle is provided with its ejection terminal perpendicularly directed against a traveling impediment screen. The processed yarn is ejected against this screen together with a heated medium flow in a plasticized state for crimping and heat setting. After crimp impartation, the crimped yarn is removed from the screen at a speed 50 to 90% of the supply speed. One typical example of this system is found in the disclosure of the U.S. Pat. No. 3,255,508. However, in the case of this method, plasticization of the filamentary strand is carried out only during the travel of the strand through the ejection nozzle and this mechanism cannot attain a sufficient provision of heat to the strand. Due to such a relatively poor heat providing faculty, the crimping system of this type is not suitable for crimping of a filamentary strand of large thickness or of a high supply speed. Further, the feature of the imparted crimps is dependent upon only the collision of the strand with the impediment screen at the time of ejection from the ejection nozzle. In other words, one cannot expect a variety in the feature of the imparted crimps.

In another of the prior art developed apparatus, for example the process disclosed in Japanese Patent Publication No. 4049/58, a yarn supplier having a central yarn guide bore encircled by a gaseous flow path, is provided with its outlet opening directed toward a crimping mechanism. The crimping mechanism includes a circulating endless belt or a rotary drum on which multiple slits or nets are formed. The yarn is supplied to the crimping mechanism being entrained on a high speed gaseous flow and the yarn is hooked onto the slits or nets in a loop state or stuffed into a stuffing chamber formed between a pair of belts or between a belt and a drum for application of a heat treatment. In this example, the stuffing chamber is formed between a pair of belts or between the belt and the drum. In other words, only two sides of the stuffing chamber is defined by the walls (belts or drum surface), but the remaining two sides of the chamber are openly constructed. Due to this structure of the chamber, the yarn stuffed within the chamber can be freely movable into the open-sides' direction and this tends to cause impartation of rough crimps and uneven crimping effect on the processed yarn.

Another of the prior art apparatus is disclosed in U.S. Pat. No. 3,367,005, wherein the processed yarn is blown by a nozzle into the meshing area of a pair of gears. In this case, the crimp imparting zone is diverged towards the nozzle outlet and due to the meshing peripheral contact of the two gears, the effective crimp imparting is very short in its length resulting in a poor crimp setting faculty. This poor crimp setting faculty forms a bar in increasing the processing speed of the yarn.

The major object of the present invention is to provide an apparatus capable of imparting random, bulky and round three-dimensional crimps to the processed filamentary strand (yarn) even at a processing speed considerably higher than these in the conventional crimping techniques.

So as to attain this object, in the apparatus of the present invention, one or more supplied filamentary strands are ejected into a stuffing chamber being entrained on a heated medium flow. The stuffing chamber is structured on an endless surface circulating at a velocity slower than the supply speed of the filamentary strands into the stuffing chamber and the remaining three sides of the stuffing chamber are defined by wall members. The stuffing chamber is covered with a stationary cover member defining the top of the stuffing chamber. At least one of the wall members or the endless surface is made as an air permeable structure so that the heating medium for the strands may be discharged therethrough.

Therefore, the fiber density of the yarn mass, formed at the inlet portion of the stuffing chamber, is gradually changed according to the resistance of the cover member which creates resistance against the carrying force due to the frictional contact with the side walls and the bottom wall of the stuffing chamber.

The above-mentioned phenomena concerning the gradually changing density of the yarn mass is hereinafter referred to as "stuffing the yarn mass".

Thusly stuffed filamentary strands are transported, being carried by the endless surface, through the stuffing chamber for a plasticization and a heat set purpose. Cooling of the strands may be effected positively during the later stage of the transportation. After completion of the crimping operation, the crimped yarn is positively delivered from the stuffing chamber to be taken up on a package or the like.

Owing to a combined effect of the compulsive stuffing into the stuffing chamber with random collision of the filament or filaments composing the strands against internal walls and/or preceding filament portions or filaments, the resultant yarn can be nicely provided with random, bulky and round three-dimensional crimps.

As for the heating medium to be used, heated dry air, overheated steam, saturated steam or hot water can be used. Overheated steam is empirically known to be most advantageously used in carrying out the method of the present invention.

The process is applicable, with advantage, to any type of fibrous materials having thermoplastic nature. In case the process is used for conjugated fibers, one can expect for an about 50% escalation in the production speed. Further, when the process is used in the crimping of split fibers, one can expect for an advanced opening of the net-structure of initially cohesive tendency. This advanced opening effect will produce an enriched bulky nature of the resultant product.

Figure 2:
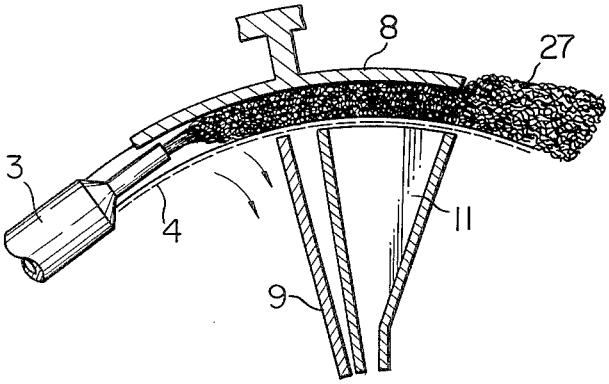
Figure 3:
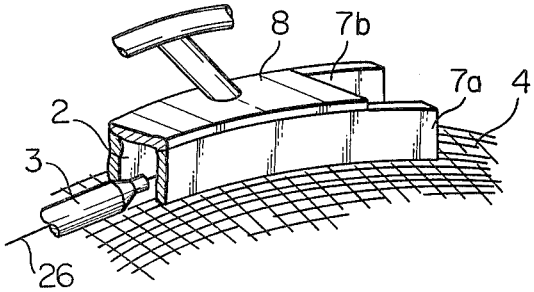

Further features and advantages of the present invention will be made more apparent from the ensuing descriptions, reference being made to the accompanying drawings; wherein FIG. 1 is a schematic side view of a basic arrangement of the apparatus of the present invention together with its related parts, FIG. 2 is a partly sectional side view of the stuffing chamber and its related parts of the apparatus shown in FIG. 1, FIG. 3 is a perspective illustration of the arrangement shown in FIG. 2.

Figure 4:
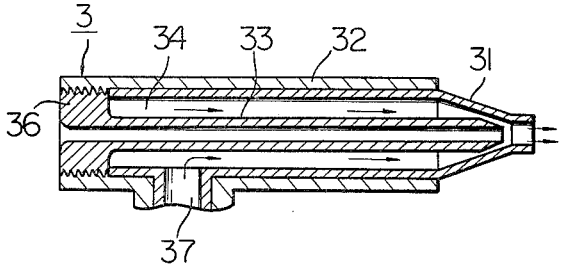
Figure 5A:
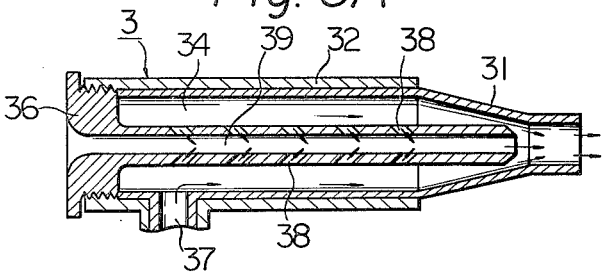
Figure 5B:
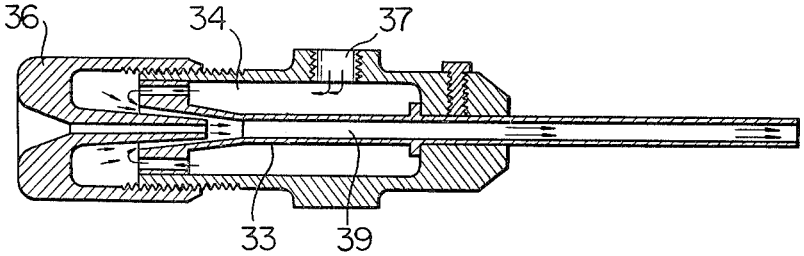
Figure 6:
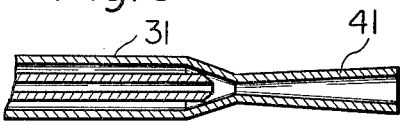
Figure 7:
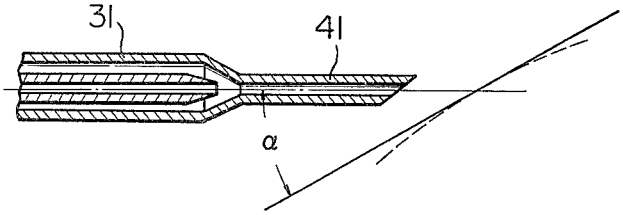
Figure 8:
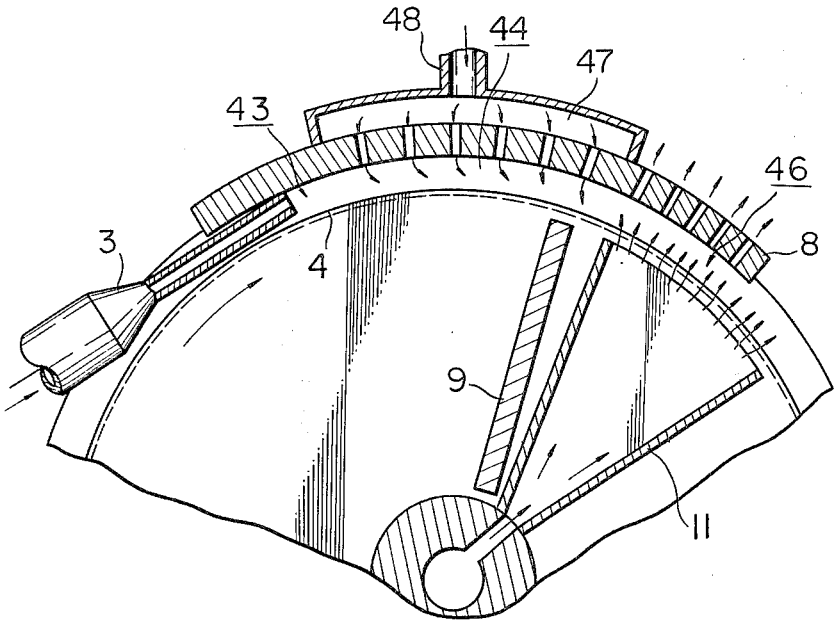
Figure 9:
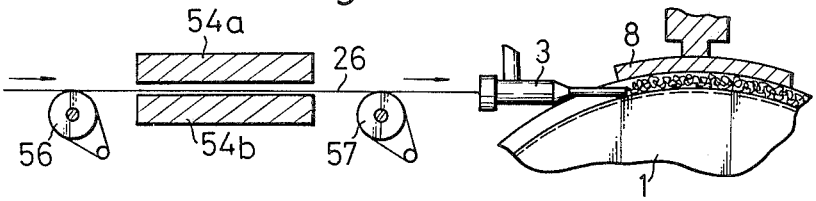
Figure 10:
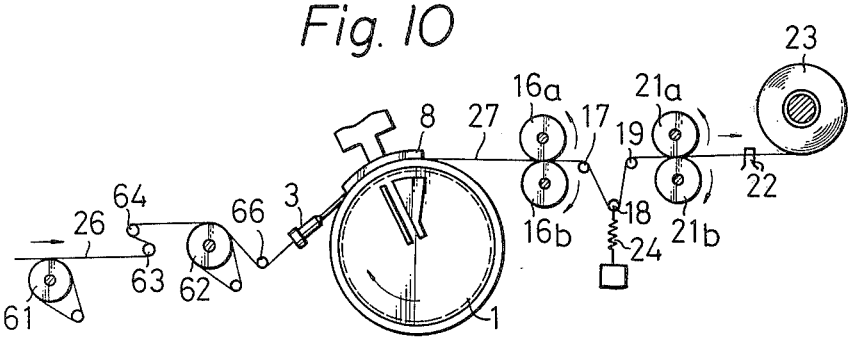
Figure 11:
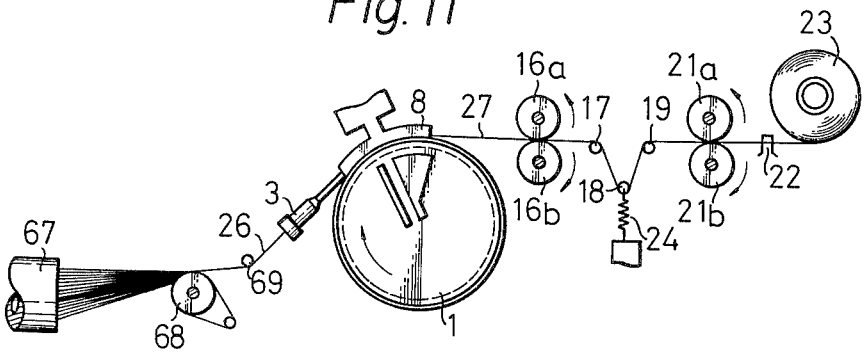
Figure 12:
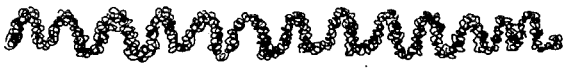
Figure 13:
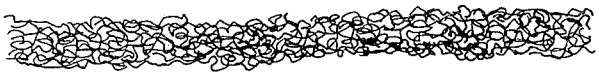
Figure 14:
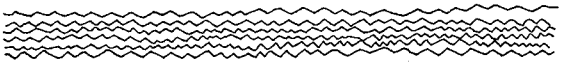

FIG. 4 is a sectional side view of a modified embodiment of the ejection nozzle used in the apparatus shown in FIG. 1, FIGS. 5A and 5B are sectional side views of modified embodiments of the ejection nozzle shown in FIG. 4, FIGS. 6 and 7 are sectional side views of modified embodiments of the ejection nozzle shown in FIG. 4, FIG. 8 is a partly sectional side view of the apparatus of the present invention having a stuffing chamber of a modified structure, FIG. 9 is a schematic side view of a modified embodiment of the apparatus shown in FIG. 1, FIGS. 10 and 11 are schematic side views of modified arrangements of the apparatus shown in FIG. 1, FIGS. 12 and 13 are enlarged side views of the crimped yarn manufactured according to the method of the present invention, FIG. 14 is an enlarged side view of the crimped yarn manufactured according to a conventional crimping method.

Referring to FIG. 1, there is shown an embodiment of the inventional apparatus with its related parts, wherein the endless surface is in the form of a cylindrical surface. However, it should be understood that the endless surface can be modified in another style also. The apparatus includes a rotary cylinder 1 provided with a stuffing chamber 2 formed locationally on a periphery of the rotary cylinder 1. On the inlet side of the apparatus, an ejection nozzle 3 is disposed with its ejection outlet directed into the stuffing chamber 2. A detailed structure of the stuffing chamber 2 is illustrated in FIGS. 2 and 3, wherein the rotary cylinder 1 is peripherally provided with a screen surface 4 and the rotary cylinder 1 rotates in a direction shown with an arrow 6. A pair of side walls 7*a* and 7*b* are fixedly mounted on the screen surface 4 encircling the cylinder 1 in a parallel arrangement to each other. The upper opening of the space defined by the side walls 7*a* and 7*b* is closed by a stationary resistant cover 8 of a suitably selected length so as to form a stuffing chamber 2 of the selected length over the screen surface 4 for creating the phenomena of stuffing the yarn mass formed at the upstream inlet of the stuffing chamber.

In the illustrated embodiment, the endless surface is in the form of the screen surface 4. Provision of such screened structure permits a smooth discharge of the blown-in heated medium outside the stuffing chamber 2. Therefore, the screened structure may be established on the side walls 7*a*, 7*b* or the stationary cover 8. Aside from occasional cases, there is no purposed impingement of the ejected strands with the screen structure, but there is impingement of the ejected strands with the preceding yarn mass in the stuffing chamber. The ejection nozzle 3 is stationarily disposed with its ejection outlet directed into the stuffing chamber 2. At a position corresponding to the midway of the stuffing room length, an internal partition 9 extends in a radial direction within the rotary cylinder 1. A cooling device 11 is also fixed within the rotary cylinder 1 such that it can eject cooling air into the stuffing chamber 2 over the length downstream of its midway location. In the above-described structure, a heated medium flow is supplied to the ejection nozzle 3 from a suitable supply source (not shown) as shown with an arrow 12 in FIG. 1, the rotary cylinder 1 is connected to a suitable flow discharging conduit (not shown) and the cooling device 11 is accompanied with a supply source (not shown) of the cooling air.

Upstream apart from the apparatus of the present invention, a pair of feed rollers 13*a*, 13*b* and a guide pin or roller 14 are provided. Downstream and apart from the apparatus, an arrangement for taking up the crimped product is provided, which arrangement includes a pair of first take-up rollers 16*a*, 16*b*, guide pins 17, 18 and 19, a pair of second take-up rollers 21*a*, 21*b*, a traversing guide 22, a take-up package 23 and a spring mechanism 24 for imparting a tension to the crimped product during the take-up operation.

With the above-described structure of the apparatus of the present invention, the crimping operation is carried out in the following sequence.

A multifilamentary yarn 26 of a thermoplastic nature is fed into the ejection nozzle 3 via the elements 13*a*, 13*b* and 14 and ejected into the stuffing chamber 2 together with the heated medium flow supplied to the ejection nozzle 3 as mentioned above. During the travel through the ejection nozzle 3, the multifilamentary yarn 26 is entrained on the heated medium flow and the individual filaments are plasticized by the heat of the medium flow. In thusly plasticized condition, the multifilamentary yarn 26 is ejectively supplied into the stuffing chamber 2. In this conjunction, the heated medium must be so pressurized, at the time supplied into the ejection nozzle 3, that the ejection velocity thereof from the downstream outlet of the ejection nozzle 3 is higher than the peripheral speed of the rotary cylinder 1.

Because the supply velocity of the multifilamentary yarn 26 is higher than the peripheral speed of the rotary cylinder 1 the multifilamentary yarn 26 is impinged against the preceding yarn mass formed in the stuffing chamber. Consequently the individual filaments are folded or curved in various shapes and form a fresh part of the yarn mass in the stuffing chamber. The yarn mass is carried to the downstream outlet of the stuffing chamber according to the carrying force created by the frictional contact with the side walls and bottom wall of the stuffing chamber formed on the rotary cylinder 1. The cover 8 creates frictional resistance against the free passage of the mass of crimped filaments, because the cover 8 is provided with a frictional surface which the mass of crimped filaments 27 contact. Consequently the carrying speed of the mass of crimped filaments is slower than the peripheral turning speed of the screen surface 4, that is, the yarn mass is displaced at a little lower speed than the moving speed of the side walls and bottom wall of the stuffing chamber. The above-mentioned movement of the yarn mass in the stuffing chamber creates compression of the yarn mass so that the fiber density of the yarn mass is gradually increased during the displacement toward the downstream outlet of the stuffing member. That is, the so-called stuffing operation is carried out while displacing the yarn mass through the stuffing chamber.

According to observations during our mill tests, the crimped material delivered from the stuffing chamber is expanded at the outside of the downstream outlet of the stuffing chamber 8, as shown in FIG. 2. Owing to this squeezing in a plasticized state, the filaments composing the yarn are provided with random crimps. The heated medium escapes into the rotary cylinder 1 via the screen surface 4 and is discharged in a known manner. Owing to the presence of the internal partition 9, the heated medium introduced into the rotary cylinder 1 does not flow into the cooling area of the stuffing chamber 2, which cooling area is formed by the cooling device 11. However, some part of the heated medium flows into the upstream half area of the stuffing chamber 2 and assists the heat setting of the crimps developed on the filaments. After this heat setting process, the filaments of the yarn 26 are cooled during their travel through the downstream half area (cooling area) of the stuffing chamber 2. After leaving the downstream terminal of the stuffing chamber 2, the crimped multifilamentary yarn 27 is taken on the take-up package 23 via elements 16*a*, 16*b*, 17, 18, 19, 21*a*, 21*b* and 22 being suitably tensioned by the element 24.

In the above-described crimping operation of the present invention, ejection of the multifilamentary yarn together with the heated medium plays an important role. In this connection, the ejection nozzle 3 must be so arranged that the ejected multifilamentary yarn will surely be received within the stuffing chamber 2. For this effect, the downstream terminal of the ejection nozzle 3 should preferably terminate inside the stuffing chamber 2. As for the ejecting direction of the ejection nozzle 3, there is no particular limitation so far as the ejected multifilamentary yarn can be surely received within the stuffing chamber 2. As above-mentioned, the screen surface 4 functions as a discharging path of the heated medium and, from the view point of the crimp impartation, it plays a role as a mere wall defining one side of the stuffing chamber 2 (see FIG. 3). So, this screen surface 4 may be formed on any of the remaining three elements 7*a*, 7*b* or 8 defining the stuffing chamber 2 as above-mentioned.

Owing to the above-mentioned particular mode of the stuffing action, the individual filaments can be provided with random, bulky and round (not sharply edged) three-dimensional crimps.

Various modifications can be derived from the above-explained structure of the apparatus of the present invention. Some of such modifications relating to the structure of the ejection nozzle 3 are shown in FIGS. 4 to 7.

In the embodiment shown in FIG. 4, a main tubular body 31 is provided with a conical ejection head and peripherally embranced by heat retaining layer 32. Coaxially with this tubular body 31, a yarn guide tube 33 extends longitudinally leaving an annular space 34 against an internal wall face of the main tubular body 31 and is provided with a peripherally threaded flange 36 formed integral of its upstream end. The threaded flange 36 engages with a threaded internal wall portion of the warmness retaining layer 32, which threaded wall portion is formed near the upstream end of the ejection nozzle 3. The annular space 34 is connected to a given supply source (not shown) of the heated medium via a supply conduit 37. As is seen in the drawing, the downstream (ejection side) end of the yarn guide tube 33 opens toward the downstream terminal opening of the main tubular body 31. Owing to this threaded engagement, the position of the yarn guide tube 33 is adjustable longitudinally with respect to the main tubular body 31. When one needs to pass the yarn through the yarn guide tube 33 at the starting of the crimping operation, the downstream end of the yarn guide tube 33 is brought into a close vicinity of the downstream terminal opening of the main tubular body 31 leaving a slight gap between the two parts by adjusting the above-mentioned threaded engagement. Then, the pressurized heated medium, for example a heated air, must pass through the thusly formed slight gap causing a suction effect operative on the internal bore of the yarn guide tube 33 and, once an end of the yarn is inserted from upstream into the yarn guide tube 33, the yarn is easily sucked into the guide tube 33 owing to the above-mentioned suction effect.

A further modification of the ejection nozzle shown in FIG. 4 is illustrated in FIG. 5A, wherein the yarn guide tube 33 is provided with a plurality of peripheral perforations 38 which are directed toward the yarn advancing direction with a certain inclination with respect to the axial line of the yarn guide tube 33. Because of the provision of these inclined perforations 38, the heated medium supplied into the annular space 34 is further partly introduced into the internal bore 39 of the yarn guide tube 33 so as to effect a supplementary heating of the yarn. In this arrangement, the downstream directed flow of the heating medium through the internal bore 39 assists the passing of the yarn therethrough at the starting of the crimping operation.

The embodiment shown in FIG. 5A can be further modified as shown in FIG. 5B, wherein the ejection nozzle is provided with a considerably elongated yarn guide tube 33 and the heated medium is introduced into the internal bore 39 from the annular space 34 via an annular gap formed at an upstream end of the yarn guide tube 33. This modified structure permits a further escalated heating effect on the processed yarn and an enriched tubulent effect on the filaments composing the yarn.

In the embodiment shown in FIG. 6, the main tube body 31 is provided with a downstream outlet portion 41 diverged outwardly. Owing to this diverged structure, the multifilamentary yarn is divergedly stuffed into the stuffing chamber 2 and this results in a desirable crimp impartation.

In the case of the embodiment shown in FIG. 7, the downstream end of the outlet portion 41 is cut obliquely like an injection needle point. By this particular structure, the end of the outlet portion 41 can be brought as near as possible to the walls defining the stuffing chamber 2 so as to obtain a better divergence of the ejected yarn.

The arrangement shown in FIG. 2 is preferably employable when the yarn processing speed is in a range from 300 to 500 m/min. However, no sufficient heat setting effect can be expected for this arrangement when the yarn speed is raised up to a range from 1,000 to 1,500 m/min. In order to meet this problem, another embodiment is shown in FIG. 8, wherein the stuffing room 2 is provided with an elongated stationary cover 8 and the stuffing room 2 is divided into three zones 43, 44 and 46. In the fist zone 43, the multifilamentary yarn is ejected from the ejection nozzle 3 into the stuffing room 2. The stationary cover 8 is made porous in the second zone 44 and an additional chamber 47 is formed covering the perforated portion of the cover 8. This additonal room 47 is connected, via a conduit 48, to a given supply source (not shown) of a heated medium. So, passing through the second zone 44, the filaments composing the yarn are subjected to contact with the heated medium introduced therein via the conduit 48 and the chamber 47 for a heat setting purpose. In succession to this second zone, the third zone 46 is structured as porous also. In this zone 46, the filaments composing the yarn are positively cooled by the cooling medium supplied from the cooling device 11, which medium is released from the stuffing room 2 primarily through the perforated portion of the stationary cover 8 as indicated with arrows in the drawing. This supplementary heat setting mechanism enables remarkable escalation of the yarn processing speed.

The cross-section of the stuffing room of the embodiment shown in FIGS. 2, 3 preferably has a width of 2 mm and a height of 3 mm.

As already mentioned, the crimping system of the present invention is remarkably excellent in its heat setting faculty when compared to the conventionally developed crimping systems. This enriched heat setting faculty assures enhanced processing speed of the yarn to be crimped. In order to further enrich this heat setting faculty, a modified embodiment, such as shown in FIG. 9 is advantageously employed.

In the arrangement shown in FIG. 9, a pair of preliminary heaters 54*a* and 54*b* are provided along the path of the yarn 26 upstream of the ejection nozzle 3. The preliminary heaters 54*a* and 54*b* are spacedly sandwiched by a pair of feed rollers 56 and 57 and the pair of heaters 54*a* and 54*b* are slightly spaced from each other so as to permit the free passage of the yarn 26 therethrough.

Because the yarn can be processed on the apparatus of the present invention at a speed higher than 300 m/min, it is possible to connect the apparatus of the present invention directly to the known drawing process. One example of this arrangement is shown in FIG. 10, wherein rollers 61, 62 and drawing pins 63, 64 are located upstream of the ejection nozzle 3. After completion of the drawing process, the drawn yarn 26 is supplied to the ejection nozzle 3 via a yarn guide 66. The apparatus of the present invention can be accompanied with a variety of drawing mechanisms such as, for example, the known hot-plate drawing.

In the embodiment shown in FIG. 11, the apparatus of the present invention is directly connected to spinneret 67 via a draw roller 68 and a yarn guide 69. After extrusion from the spinneret 67, the spun-drawn yarn 26 is supplied into the ejection nozzle 3.

Although, in the illustrated embodiments, a single strand of yarn is processed through the crimping apparatus of the present invention, it goes without saying, that supplying multiple strands of yarns without any particular trouble to the apparatus simultaneously can be performed and after completion of crimp impartation, to divide the assembled mass into individual yarns so as to take them up onto the respective packages. In this case, multiple yarns are ejected together from the ejection nozzle 3 and, without entanglement with each other, are dispersed into the stuffing room 2 for a stuffing purpose. At the downstream outlet of the stuffing room 2, the multiple yarns are massed together in the form like a single strand and by a suitably added mechanism, the respective yarns are indivisualized from their associated single strand.

It is also employable in relation to the crimping system of the present invention to supply a non-twisted filamentary bundle to the apparatus of the present invention and, after completion of the crimp impartation, to divide the bundle into the respective filaments.

The crimping system of the present invention is applicable not only to filaments of ordinary straight shape, but also to filaments of latently crimpable nature. Particularly, in this case, one can expect marvelously enhanced crimping effects owing to the particular thermal nature of the filaments of this type.

Further, the crimping system of the present invention can advantageously be applied to a fibrillated tape of an easily splittable nature. In this case, the tapes are easily split into split fibers during the ejection from the ejection nozzle and stuffed into the stuffing room. The system of the present invention can be applied to various types of processes in the textile manufacturing.

In order to prove the advantageous features of the present invention, several examples are illustrated as follows.

EXAMPLE 1

A polypropylene multifilamentary yarn of 1,850 denier/120 filaments was processed through the apparatus shown in FIG. 1 at a supply speed of 275 m/min. The processing conditions were as follows.

| | |
|---|---|
| Type of ejection nozzle | FIG. 4 |
| Overheated steam supplied to the nozzle | 155° C temperature and 1.85 kg/cm$^2$ pressure |
| Screen surface | Stainless net of 26 mesh |
| Ratio of the supply speed with respect to the circulating velocity of the screen surface | 14 |
| Cooling air | 10° C temperature and 4.5 m/sec speed |

The crimped yarn manufactured was provided with a random, round bulky and soft crimp configuration such as shown in FIGS. 12 and 13.

A yarn of similar particulars was processed through the conventional stuffing box type crimper and the resultant yarn was provided with a sharply edged crimp configuration of pool bulkiness, rough touch and poor difference in the phase of the crimps between filaments composing the yarn as shown in FIG. 14.

The qualities of the yarns were measured and the obtained results were as shown in Table 1.

Table 1

| Samples | Yarn of the present invention | Yarn of the conventional crimper |
|---|---|---|
| Strength at break in g/denier | 3.54 | 3.15 |
| Percent elongation at break | 40.3 | 32.9 |
| Percent crimp elongation | 38.7 | 30.1 |
| Percent crimp | 25.4 | 15.3 |
| Percent crimp elongation recovery | 91.0 | 83.4 |

In this connection, measurements of the properties relating to crimp were performed in the following particulars.

A yarn hank of 5 winds and 1 meter circular length for each wind was hung on a metal bar for 16 hours and dry heated at a temperature 70° C for 10 minutes for a maximum development of the crimps. After 4 hours' interval, the yarn hank was subjected to an initial loading of 1 mg/denier and 1 minute later, the length "$l_o$" of the yarn hank was recorded. Next, the yarn hank was subjected to a loading of 100 mg/denier and 1 minute later, the length "$l_1$" thereof was recorded. 2 minutes after unloading, the yarn hank was again subjected to a loading of 1 mg/denier and 1 minute later, the length "$l_2$" thereof was recorded. Using thusly recorded lengths, the values recited in the table were calculated as follows;

$$\text{Percent crimp elongation} \times \frac{l_1 - l_0}{l_0} \times 100$$

$$\text{Percent crimp} = \frac{l_1 - l_2}{l_1} \times 100$$

$$\text{Percent crimp elongation recovery} = \frac{l_1 - l_2}{l_1 - l_0} \times 100$$

The above-described definition of the values is applicable to the following examples also.

EXAMPLE 2

A nylon 6 multifilamentary yarn of 1,260 denier/60 filaments was processed, at a supply speed of 600 m/minthrough the apparatus of FIG. 9.

The preliminary heater was provided with an internal diameter of 4.5 mm and the length thereof was 1,000 mm. The temperature of the heater was 185° C and the other processing conditions were similar to those employed in Example 1. The crimped yarn was provided with an appearance such as shown in FIG. 13 and the crimp properties thereof was as is shown in Table 2.

Table 2

| | |
|---|---|
| Strength in g/denier | 4.47 |
| Percent elongation | 31.4 |
| Percent crimp elongation | 46.5 |
| Percent crimp | 27.0 |
| Percent crimp elongation recovery | 93.4 |

EXAMPLE 3

A polyester multifilamentary undrawn yarn of 1,140 denier/60 filaments was processed in the apparatus shown in FIG. 10, wherein the draw ratio was selected as 3.51, the temperature of the first drawing pin 63 was 66' C and that of the pin 64 was 148' C. The stuffing room structure was as shown in FIG. 8. The temperature of the heated steam ejected from the ejection nozzle 3 was 190' C, the steam temperature supplied into the second zone 44 was 185' C and the remaining process conditions were similar to those in Example 1. The resultant yarn was provided with a crimp configuration shown in FIG. 13 and the crimp properties thereof was as shown in Table 3.

Table 3

| | |
|---|---|
| Strength in g/denier | 4.50 |
| Percent elongation | 33.4 |
| Percent crimp elongation | 39.4 |
| Percent crimp | 26.9 |
| Percent crimp elongation recovery | 88.5 |

EXAMPLE 4

Polypropylene was extruded from a spinneret 67 in FIG. 11 so as to form a polypropylene mulfifilamentary yarn of 1,050 denier/60 filaments, 2.30 g/denier strength and 205% elongation and the yarn was processed to the stuffing room of the type shown in FIG. 8. The particulars of the process conditions were as follows.

| | |
|---|---|
| Temperature of the spinneret head in ° C | 275 |
| Temperature of the draw roller in ° C | 150 |

-continued

| | |
|---|---|
| Surface speed of the draw roller in m/min | 1050 |
| Type of ejection nozzle | FIG. 5 |
| Temperature of the steam supplied to the nozzle in ° C | 160 |
| Temperature of the steam supplied to the second zone in ° C | 158 |

The crimp configuration possessed by the obtained yarn was as shown in FIG. 13 and the crimp properties thereof was as shown in Table 4.

Table 4

| | |
|---|---|
| Strength in g/denier | 2.51 |
| Percent elongation | 163 |
| Percent crimp elongation | 37.5 |
| Percent crimp | 25.0 |
| Percent crimp elongation recovery | 86.3 |

EXAMPLE 5

Three nylon 6 multifilamentary yarns of 840 denier/60 filaments were plied together and the plied yarn was processed to the apparatus shown in FIG. 1. The process conditions were similar to those employed in Example 1 with exception that the processing speed was 200 m/min and the ratio of the supply speed to the traveling speed of the screen surface was 10. The obtained yarn was provided with a desirable crimp configuration and was suitable for use in interior decoration and clothesware.

EXAMPLE 6

Polymer pellets were prepared by adding a suitable stabilizer to a polypropylene polymer having an intrinsic viscosity [$\eta$] 1.53 with respect to tetraline of 135° C temperature. Thusly prepared polymer pellets were processed by separate extrusions at temperatures 255° C and 328° C. The obtained polymer melts were extruded through a spinneret of 120 holes at a supply ratio of 1 : 1. The spinning temperature was 245° C and the intrinsic viscosities [$\eta$] of the polymer melts at the spinning stage were 1.42 and 1.15. Thusly obtained undrawn multifilamentary yarn of 4,250 denier was processed in the apparatus shown in FIG. 10, wherein the drawing pins 63 and 64 were omitted, and the yarn was drawn in the zone between the rollers 61 and 62 at a draw ratio of 2.98 without application of heat. The supply speed of the yarn was 1,543 m/min and the stuffing room structure shown in FIG. 8 was adopted. the temperature of the ejection nozzle steam was 168° C, that of the second zone steam was 160° C and other process conditions were selected similar to those in Example 1. The acquired crimped yarn was provided with properties such as shown in Table 5.

Table 5

| | | |
|---|---|---|
| Thickness in denier | | 1,760 |
| Strength in g/denier | | 2.90 |
| Percent elongation | | 67.8 |
| Percent crimp elongation | | 57.9 |
| Percent crimp | | 33.7 |
| Percent crimp elongation recovery | | 88.5 |
| Percent shrinkage in boiling water | Before crimping | 18.3 |
| | After crimping | 2.1 |

EXAMPLE 7

Polymer pellets were prepared by adding a suitable stabilizer to an isotactic polypropylene of 2.0 intrinsic viscosity with respect to tetraline of 135° C temperature. Thusly prepared polymer pellets were subjected to separate extrusions at temperatures 260° C and 310° C. The obtained polymer melts were spun through a spinneret of 60 holes at a supply ratio of 1 : 1. Thusly obtained undrawn multi-filamentary yarn of 2,500 denier/60 filaments was processed in the apparatus shown in FIG. 10, wherein the drawing pins 63 and 64 were omitted and the drawing was performed between the rollers 61 and 62 at a draw ratio of 2.87 without application of heat. The drawn yarn was next processed to the crimping apparatus at a supply speed of 1,521 m/min under the following process conditions.

| | |
|---|---|
| Type of ejection nozzle | FIG. 4 |
| Pressure of the nozzle steam in kg/cm² | 3.0 |
| Screen surface 4 | Stainless net of 28 mesh |
| The ratio of the supply speed to the traveling speed of the screen surface | 18 |
| The cooling air | 10° C temperature and 5.5 m/sec speed |

The properties of the yarn thusly crimped was as shown in Table 6.

Table 6

| | | |
|---|---|---|
| Thickness in denier | | 915 |
| Strength in g/denier | | 2.84 |
| Percent elongation | | 87 |
| Percent crimp elongation | | 63.0 |
| Percent crimp | | 47.5 |
| Percent crimp recovery | | 88.3 |
| Percent shrinkage in boiling water | Before crimping | 15.4 |
| | After crimping | 0.8 |

It should be noted, that in this example, the ejection nozzle was provided with saturated steam but not with overheated steam.

EXAMPLE 8

Polyester pellets having an intrinsic viscosity of 0.65 with respect to a mixed solution of tetrachloroethane with phenol of 120° C temperature were subjected to separate extrusion at temperatures 350° C and 280° C. The obtained polymer melts were spun at a supply ratio of 1 : 1 and a spinneret temperature of 283° C. The spinning speed was selected as 1,000 m/min and the obtained yarn had a total thickness of 1,700 denier and contained 60 filaments. Thusly, obtained undrawn yarn was processed to the apparatus shown in FIG. 10, wherein the temperatures of the drawing pins 63 and 64 were selected as 82° C and 162° C, respectively, and the drawing was carried out in between the rollers 61 and 62 at a draw ratio of 3.00. After the drawing, the drawn yarn was supplied to the crimping apparatus at a yarn speed of 875 m/min under the following process conditions.

| | |
|---|---|
| Type of ejection nozzle | FIG. 4 |
| Overheated ejection nozzle steam | 185° C temperature and 3.4 kg/cm² pressure |
| Screen surface | Stainless net of 28 mesh |
| The ratio of the supply speed to the traveling speed of the screen surface | 25 |

-continued

| | |
|---|---|
| The cooling air | 10° C temperature and 5.5 m/min speed |

The acquired crimped yarn was provided with such crimp properties as is shown in Table7.

Table 7

| | | |
|---|---|---|
| Thickness of the yarn in denier | | 535 |
| Strength in g/denier | | 3.80 |
| Percent elongation | | 64 |
| Percent crimp elongation | | 58.5 |
| Percent crimp | | 44.8 |
| Percent crimp recovery | | 89.5 |
| Percent shrinkage in boiling water | Before crimping | 12.3 |
| | After crimping | 0.6 |

EXAMPLE 9

Polymer pellets of nylon 6 and nylon 66 were separately prepared and extruded respectively at a temperature of 280° C. The obtained polymer melts were spun at a spinning temperature of 275° C and a supply ratio of 1 : 1. Thusly, obtained undrawn yarn of 3,500 denier/90 filaments was processed to the apparatus shown in FIG. 10, wherein the drawing pins 63 and 64 were omitted and the drawing was carried out in between the rollers 61 and 62 at a draw ratio of 3.00 without application of heat. Next, the drawn yarn was supplied to the crimping apparatus at a supply speed of 820 m/min and under the following process conditions.

| | |
|---|---|
| Type of ejection nozzle | FIG. 4 |
| The saturated steam supplied to the nozzle | 3.2 kg/cm² pressure |
| Screen surface | Stainless net of 28 mesh |
| The ratio of the supply speed with respect to the screen surface traveling speed | 18 |
| The cooling air | 10° C temperature and 5.5 m/sec speed |

The obtained crimped yarn was provided with the crimp properties such as shown in Table 8.

Table 8

| | | |
|---|---|---|
| Thickness in denier | | 1,240 |
| Strength in g/denier | | 3.75 |
| Percent elongation | | 57 |
| Percent crimp elongation | | 84 |
| Percent crimp | | 53.9 |
| Percent crimp recovery | | 94.5 |
| Percent shrinkage in boiling water | Before crimping | 10.3 |
| | After crimping | 0.7 |

EXAMPLE 10

Molten polypropylene was extruded from an extruder at 275° C temperature through an application of an inflation method so as to produce an undrawn polypropylene film. Next, the film was stretched at a stretching ratio of 6.0 at 135' C temperature while slitting the film into multiple strips. A plurality of tape-yarns, each having 0.2 mm thickness and 1.3 mm width, were thus prepared. Then the tape yarns were split so as to form split yarns of net-structure.

Thusly obtained polypropylene split yarns were subjected to the crimping process under conditions substantially similar to those employed in Example 1. The obtained crimped yarn was accompanied with excellent bulky nature.

What is claimed is:

1. An improved crimping apparatus for crimping one or more filamentary strands of thermoplastic material, comprising in combination, a rotary cylinder having a cylindrical surface, a curved tunnel-shaped stuffing chamber defined by a portion of said cylindrical surface, spaced opposite arcuate stationary side walls disposed normal to the axis of said cylinder and having radially inner arcuate edges adjacent and conforming to said cylindrical surface and a stationary arcuate cover extending between radially outer edges of said side walls and spaced from said cylindrical surface which constitutes the bottom of said stuffing chamber; an ejection nozzle for said filamentary strands having the ejection end of the nozzle terminating inside said stuffing chamber and directed approximately circumferentially of said cylinder in the direction of rotation of said cylinder; means for supplying a heated medium into said ejection nozzle; means for supplying said filamentary strand to said ejection nozzle for ejection at a controlled rate into said stuffing chamber by said heated medium; and means for taking up said strands delivered from a downstream outlet of said stuffing chamber.

2. An improved crimping apparatus according to claim 1, further comprising means for positively supplying a cooling medium of said filamentary strands into a downstream region of said stuffing chamber.

3. An improved crimping apparatus according to claim 1, wherein said resistance cover is provided with a middle perforated portion, an additonal room is formed covering said perforated portion of said cover, said additional room is connected to a given supply source of said heated medium.

4. An improved crimping apparatus according to claim 1, further comprising a pair of preliminary heaters provided along the path of said filamentary strand upstream of said ejection nozzle.

5. An improved crimping apparatus according to claim 1, wherein said ejection nozzle is disposed right after a delivery roller of a drawing process so that said filamentary strands delivered from said delivery roller of said drawing process is directly supplied into said ejection nozzle.

6. An improved crimping apparatus according to claim 1, wherein said ejection nozzle is disposed at a position after a drawing roller of a spinning machine so that said filamentary strand delivered from said drawing roller is directly supplied into said ejection nozzle.

7. An improved crimping apparatus according to claim 1, wherein said cylindrical surface of said cylinder is a screen surface through which said heated medium can pass from said stuffing chamber.

8. An improved crimping apparatus according to claim 7, further comprising means inside said cylinder for directing a fluid cooling medium through said screen surface into a downstream portion of said stuffing chamber.

9. An improved crimping apparatus according to claim 7, in which a portion of said cover is perforate and in which means is provided for directing a fluid through said perforate cover portion into said stuffing chamber and discharging said fluid at least in part through said screen surface into said cylinder.

* * * * *